US008015670B2

(12) United States Patent
Stover

(10) Patent No.: US 8,015,670 B2
(45) Date of Patent: Sep. 13, 2011

(54) MODULE FEEDER WITH NON-TRAVELING UNWRAPPER

(75) Inventor: Jimmy R. Stover, Corpus Christi, TX (US)

(73) Assignee: Stover Equipment Co. Inc., Corpus Christi, TX (US)

( * ) Notice: Subject to any disclaimer, the term of this patent is extended or adjusted under 35 U.S.C. 154(b) by 316 days.

(21) Appl. No.: 12/378,914

(22) Filed: Feb. 18, 2009

(65) Prior Publication Data

US 2009/0205932 A1 Aug. 20, 2009

Related U.S. Application Data

(60) Provisional application No. 61/066,162, filed on Feb. 19, 2008.

(51) Int. Cl.
*D01B 1/04* (2006.01)

(52) U.S. Cl. ..... 19/64.5; 19/97.5

(58) Field of Classification Search ..... 19/64.5, 19/97.5; 414/411, 412
See application file for complete search history.

(56) References Cited

U.S. PATENT DOCUMENTS

| | | | | |
|---|---|---|---|---|
| 2,989,252 | A | 6/1961 | Babb | |
| 3,897,018 | A * | 7/1975 | Wilkes et al. | 241/223 |
| 3,949,448 | A * | 4/1976 | Willcutt et al. | 19/80 R |
| 3,968,940 | A | 7/1976 | Godbersen | |
| 4,057,876 | A | 11/1977 | Sawyer | |
| 4,390,312 | A | 6/1983 | Skeem | |
| 4,592,698 | A | 6/1986 | Semp | |
| 4,610,596 | A | 9/1986 | Bouldin | |
| 4,827,699 | A | 5/1989 | Shauman | |
| 4,897,010 | A | 1/1990 | Golley | |
| 4,929,141 | A | 5/1990 | Keesey | |
| 5,067,870 | A | 11/1991 | Staffanson | |
| 5,179,878 | A | 1/1993 | Kranefeld | |
| 5,228,628 | A | 7/1993 | Temburg | |
| 5,318,399 | A | 6/1994 | Marom | |
| 5,371,938 | A | 12/1994 | Martin | |
| 5,454,683 | A | 10/1995 | Marom | |
| 5,771,661 | A | 6/1998 | Martin | |
| 6,848,238 | B2 | 2/2005 | Korhonan | |
| 7,165,928 | B2 | 1/2007 | Haverdink | |
| 2006/0191241 | A1 | 8/2006 | Deutsch | |
| 2007/0181469 | A1 | 8/2007 | Stover | |
| 2008/0052876 | A1 | 3/2008 | Stover | |
| 2009/0205932 | A1 | 8/2009 | Stover | |

* cited by examiner

*Primary Examiner* — Shaun R Hurley
(74) *Attorney, Agent, or Firm* — G. Turner Moller

(57) ABSTRACT

A system for removing plastic wrapping from round cotton modules includes a gantry having a stationary base located in front of a disperser. A separate conveyor between the gantry and the disperser receives unwrapped round cotton modules from the gantry. Because the gantry is stationary while the disperser digests an upstream module, a gap is created between the upstream module and the module being unwrapped. This gap is closed up when the most recently unwrapped module is placed on the separate conveyor which is driven at a high rate of speed to abut, nor nearly abut, the modules.

12 Claims, 1 Drawing Sheet

MODULE FEEDER WITH NON-TRAVELING UNWRAPPER

This application is based on Provisional Application Ser. No. 61/066,162, filed Feb. 19, 2008 on which priority is claimed.

This invention relates to an improved method and apparatus for removing a plastic wrapping from a round cotton module.

BACKGROUND OF THE INVENTION

This invention is an improvement over the disclosures in application Ser. Nos. 11/350,314 and 11/904,208, the disclosures of which are incorporated herein by reference.

As explained in these applications, a development is underway in the handling of seed cotton from the time it is picked until it enters a gin. In the recent past, seed cotton from a picker is dumped into a module builder on the edge of a field. The cotton is tamped in the module builder until a large rectangular module is created which is ultimately unloaded from the module builder. A plastic cover is draped over the module and the covered module sits in the field until it is moved by a special truck to a gin yard where the module sits until it is ginned. In order to minimize water and other damage to the seed cotton before it enters the gin, there has been developed a cotton picker that creates plastic wrapped round or cylindrical modules. Because these modules are wrapped in plastic, no water wicks up from the ground to damage the seed cotton and rain does not seep through holes developed in conventional tarp covered modules.

In these above patent applications, there is disclosed a gantry on which the plastic removal devices are mounted and this gantry is mounted for movement toward and away from a disperser where the cotton module is disintegrated into clumps which can be handled by the gin. Moving the gantry is done in an attempt to abut the modules end to end, or nearly so, when the plastic has been removed from the modules. The purpose is to eliminate or minimize any gap between successive modules so the disperser, and thus the gin, is never starved of cotton. This is particularly true for cotton gins which do not have a feed controller between the module feeder and the gin. Although only about 20% of cotton gins do not have feed controllers, installing a feed controller is no small chore because, at current prices, they are about $180,000 installed.

SUMMARY OF THE INVENTION

In this invention, the gantry is stationary so a gap is created between an unwrapped downstream cotton module which is headed into, or already in, the disperser and a module which is currently being unwrapped. The reason for the gap is that the upstream module is not moving in the direction of travel of the conveyors while the downstream module is moving into the disperser.

Instead of the gantry moving toward the disperser at the same speed as the downstream module, as in the above patent applications, the gantry under which the upstream module is being worked on is not moving toward the disperser, i.e. its base is stationary. The concept is to provide a separately controlled conveyor between the gantry and the disperser, upstream of a conveyor inside the disperser. With this modification, the module which has just been unwrapped can be moved more rapidly toward the disperser than the downstream module is being processed by the disperser. In this manner, the module which has just been unwrapped can be closed up against the downstream module to avoid a gap between the modules when the later module begins to be digested by the disperser. This invention thus recognizes that it is not important to prevent gaps between the modules until the gap gets to the disperser heads.

In this invention, the gantry is spaced upstream from the disperser a substantial distance and an individually controllable conveyor is provided between the outlet end of the gantry and the inlet of the disperser. In some retrofit situations where the gin has an existing conveyor that is suitable, such as a roller bed conveyor, the existing conveyors are used but modified to relocate the gaps between adjacent conveyors. When the conveyor layout at a gin is not suitable, existing conveyors are moved in an upstream direction and an additional individually controllable conveyor is inserted between the inlet of the disperser and the gantry. When the gantry mounted equipment removes the plastic and places the module back onto the conveyor, the conveyor between the outlet end of the gantry and the disperser are selectively sped up to close the gap between the module just worked on and the end of the module downstream from the one just worked on.

It is accordingly an object of this invention to provide an improved method and apparatus for removing a plastic wrapping from a round cotton module.

Another object of this invention is to provide a plastic wrap removing device for round cotton modules which incorporates a stationary gantry.

A further object of this invention is to provide a plastic wrap removing device for round cotton modules which produces gaps between adjacent modules upstream of a disperser and conveyors which can be sped up to close the gaps.

These and other objects and advantages of this invention will become more apparent as this description proceeds, reference being made to the accompanying drawings and appended claims.

DETAILED DESCRIPTION OF THE INVENTION

Figure 1:
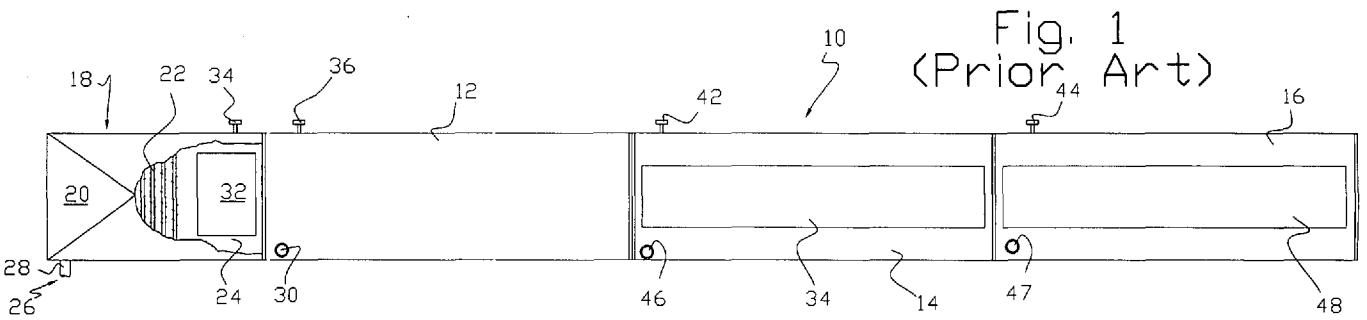
Fig. 1 (Prior Art)
FIG. 1 is a schematic top view of a conventional module feeder for handling rectangular cotton modules.

Referring to FIG. 1, a conventional module feeder 10 for handling rectangular modules includes a series of conveyors 12, 14, 16 feeding modules toward a disperser 18 comprising a hood 20 covering a series of disperser drums 22 and a short conveyor 24 under the hood 20. A conveyor 26, which is typically a pneumatic system, delivers cotton clumps through a conduit 28 to the gin. An electric eye or laser 30 spaced somewhat upstream from the disperser 18 detects the end of the module 32 which is currently being digested in the disperser 18 as more fully explained hereinafter.

The short conveyor 24 is separately driven by a motor 34, i.e. its speed is independent of the speed of the conveyor 12 which is controlled by a motor 36. The speed of the short conveyor 24 controls the amount of cotton being digested by the disperser 18 and is thus dictated by the demands of the gin. The conveyors 14, 16 are also separately controlled by motors 42, 44 and electric eyes or lasers 46, 47 as explained more fully hereinafter. A module truck (not shown) unloads a module onto the conveyor 16 when it is empty.

During normal operation, a module 32 is moving off the conveyor 12 onto the short conveyor 24 and being digested by the disperser drums 22. So long as the module 32 is at least partly on the conveyor 12, the conveyor 12 and the short conveyor 24 are run at the same speed, usually fairly slow, while the conveyor 14 is stopped. When the module 32 clears the conveyor 12, this is detected by the electric eye 30 which starts the motor 42 and runs it at a fast speed and also speeds up the motor 36 so the conveyors 12, 14 run at an equal fast speed. By the time the front of the module 34 reaches the electric eye 30, the module 32 has moved a few inches downstream from the electric eye 30. If the conveyor 12 were stopped immediately when the electric eye 30 detects the module 34, a gap would exist between the modules 32, 34. Instead, a delay of a few seconds is incorporated into the control mechanism to run the conveyor 12 somewhat longer so the module 34 is pushed a few inches onto the short conveyor 24 so it abuts, or nearly abuts, the module 32. The exact amount of the delay is determined by trial and error and then set into the mechanism controlling the motors 34, 36, 42, 44.

When the module 34 comes to rest on the conveyor 12, the conveyor 14 is empty, which is detected by the electric eye 46 because it no longer sees the module 34. This starts the motor 44 which runs the conveyor 16 along with the conveyor 14 to transfer the module 48 on the conveyor 16 to the conveyor 14. When the module 48 trips the electric eye 46, this stops the motor 42 and thus stops the conveyor 14. When the module 48 leaves the conveyor 16, this is detected by the laser 47 which stops the conveyor 16. This leaves the conveyor 16 empty so it may be loaded by a module truck (not shown) working in the gin yard.

By operating the conveyors 12, 14, 16 in response to the presence or absence of modules as detected by the electric eyes 30, 46, 47, rectangular modules are more-or-less continuously fed into the disperser 18 as will be recognized by those skilled in the art. Specifically, when the electric eye 30 recognizes that the end of the module 32 has passed completely onto the short conveyor 24, the conveyors 12, 14 are run at a higher speed than the short conveyor 24 so the second module 34 runs up to the first module 32.

Figure 2:
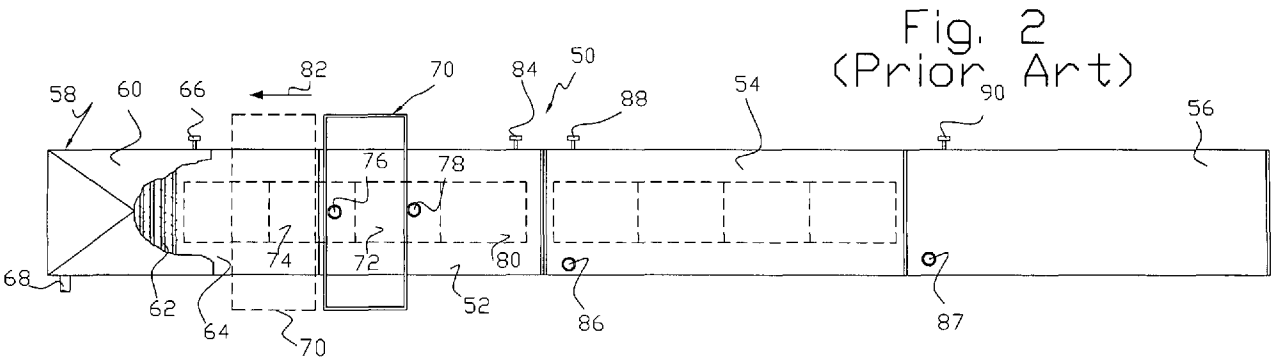
Fig. 2 (Prior Art)
FIG. 2 is a schematic top view of a module feeder of the type disclosed in application Ser. Nos. 11/350,314 and 11/904,208, i.e. the gantry moves toward and away from the disperser.

Referring to FIG. 2, the module feeder 50 is of the type shown in U.S. application Ser. Nos. 11/350,314 and 11/904,208 and comprises a series of conveyors 52, 54, 56 upstream of a conventional disperser 58 having a hood 60, a series of disperser drums 62, a short conveyor 64 driven by a motor 66 and a pneumatic outlet conduit 68 delivering cotton clumps to the gin. The length of the short conveyor 64 has been increased to extend substantially out of the hood 60. Because the length of current round modules is 8', the short conveyor 64 extends at least 8' out of the hood 60 for purposes more fully explained hereinafter. In gins where the conveyors are roller bed conveyors, this is relatively simple because the roller drives and/or the conveyor belts may be shifted to change the gap between adjacent conveyors. In gins where the conveyors are chain bed conveyors, the situation is more difficult and the conveyors have to be replaced and/or more extensively modified.

A gantry 70 straddles the conveyor 52 and is mounted for movement, typically on wheels, toward and away from the disperser 58 between the solid and dashed line positions in FIG. 2. In its most upstream position, the gantry 70 is typically just upstream from the gap between the conveyors 52, 64. The gantry 70 includes mechanisms to pick up a round plastic wrapped module 72, remove the plastic wrapping and then set the unwrapped module 74 back onto the conveyor 52. Because the modules 72, 74 are currently made to be 8' long, one end of gantry movement is about 8' from the end of the conveyor 52 as shown in solid lines in FIG. 2. The other end of gantry movement is about 8' onto the short conveyor 64 as shown in dashed lines. An electric eye or laser 76 on the gantry 70 detects a separation or gap between the wrapped upstream module 72 and an unwrapped downstream module 74. If a gap appears, it will be detected by the electric eye 76 which starts the conveyor 52 moving at a higher speed so the modules 72, 74 abut at a time before a laser 78 detects the end of the module 72 so the gantry 70 and the modules move together.

A second electric eye 78 on the gantry 70 detects a separation between the module 72 and an upstream module 80. In other words, the two eyes 76, 78 determine when the module 72 to be worked on is in position under the gantry 70. The gantry 70 picks up the module 72, removes the plastic covering and moves toward the disperser 58 in the direction shown by the arrow at the same speed as the module 74 is moving toward the disperser 58. In other words, the gantry 70 moves from the solid line position in FIG. 2 to the dashed line position as the wrapper is being removed. The gantry 70 thus sets the module 72 down in the same location relative to the module 74 that it was picked up. Thus, there is normally no gap created between the adjacent modules 72, 74 caused by the time delay during which the wrapper is removed. Thus, there is no gap between the modules 72, 74 when the module 74 enters the disperser 58 and the gin is not starved of cotton. This is accomplished by closing up the modules upstream of the gantry 70 and then moving the gantry 70 at the same speed as the downstream module 74 is moving through the disperser 58. It will thus be seen that the conveyor 52 is driven by a motor 84 at a more-or-less constant speed equal to the speed of the short conveyor 64 inside the disperser 58.

One or more electric eyes 86, 87 control motors 88, 90 so a series of unwrapped modules may be presented to the gantry 70 and thereby deliver a continuous supply of cotton through the disperser 58 to the gin. Thus, the conveyors 54, 56 are sometimes run at faster speeds in order to close up modules presented to the conveyor 52. It will thus be seen that the conveyor arrangements of the prior art embodiments of FIGS. 1 and 2 differ only in the length of the short conveyors 24, 64. In gins which are retrofit to accommodate module feeders which can handle round plastic wrapped modules, it is much easier to modify roller bed conveyors than to restructure chain bed conveyors but this is an unavoidable problem because of the pre-existing conditions in the gin.

In normal operation, the electric eye 78 detects when a module 72 is under the gantry 70 thereupon starting the unwrapping operation which includes lifting the module 72 off the conveyor 52. In normal operation, the gantry 70 moves at the same speed as the short conveyor 64 to the dashed line position in FIG. 2 so the module 72 is replaced onto the short conveyor 64 immediately behind the module 74. After the module 74 is replaced onto the short conveyor 64, the gantry 70 moves back to the solid line position in FIG. 2 to await the next successive module.

Figure 3:
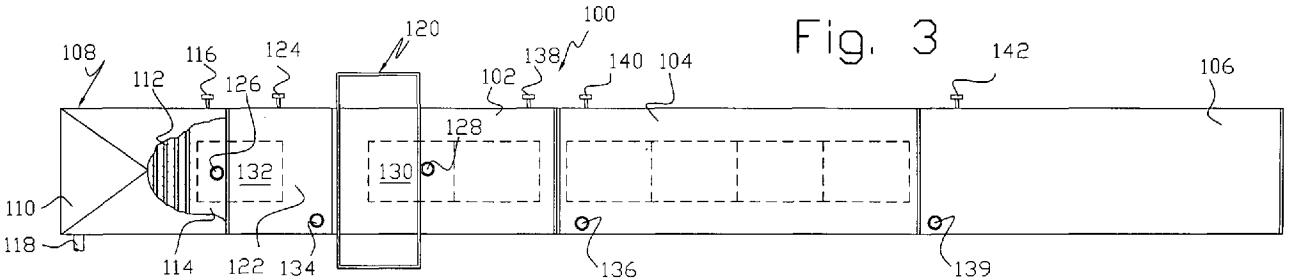
FIG. 3 is a schematic top view of the module feeder of this invention illustrating a stationary gantry.

Referring to FIG. 3, the module feeder 100 of this invention comprises a series of conveyors 102, 104, 106 feeding round modules toward a conventional disperser 108 comprising a hood 110 covering a series of disperser drums 112 and a short conveyor 114 under the hood 112 driven by a separate motor 116. An outlet conduit 118 delivers cotton clumps to the gin. The short conveyor 114 may, but need not, extend out of the disperser hood 110. This is the normal situation in conventional module feeders, as shown in FIG. 1, meaning that retrofitting existing module feeders with this invention does not normally require modification of the conventional disperser 108 or the short conveyor 114.

The module feeder 100 incorporates a gantry 120 having a base which does not move and comprises a structure which straddles the conveyor 102. In some embodiments, many of the operating components of the plastic removing device shown in application Ser. Nos. 11/350,314 and 11/904,208 are located on the gantry 120, such as a device for picking a module up off the underlying conveyor and a device for removing the plastic wrapping from the module.

A separate conveyor 122, independently driven by a motor 124, is provided between the downstream end of the gantry 120 and the inlet end of the short conveyor 114. A first electric eye or laser 126 on the disperser hood 110 and a second electric eye or laser 128 on the gantry 120 operate in much the same manner as the eyes 76, 78. The conveyor 122 moves a module 132, which has just had its plastic cover removed, toward the inlet of the short conveyor 114. The conveyor 102 moves the module 130 toward the stationary gantry 120. When the laser 128 detects the rear end of the module 130, this starts operation of the unwrapping mechanisms of the gantry 120. When the unwrapping operation is complete, the gantry 120 sets the module back onto the conveyor 102 at a time when the conveyor 102 is stationary and when the unwrapped upstream downstream module 132 is being moved into the disperser 108 thereby creating a gap between the modules 130, 132. Thus, the conveyor 102 is initially stopped while the conveyor 122 is moving at a slow speed which necessarily creates a gap between the stationary module 130 and the moving module 132. So long as a module straddles the conveyors 114, 122, the conveyors 114, 122 are driven at the same speed and the conveyor 102 is stopped.

When the rear end of module 132 is detected by the laser 126, meaning that the module 132 is completely on the short conveyor 114, this starts the conveyors 102, 122 at a high rate of speed, much higher than the speed of the conveyor 114 thereby closing the gap. When the front of the module 130 is detected by the laser 126 most, but not all of the gap, has been closed up because the module 132 has continued to move, but at a much lower speed.

If the conveyor 122 were run at a fast speed and then stopped immediately when the electric eye 126 detects the front of the module 130, a small gap would still exist between the modules 130, 132 because the module 132 would move a short distance while the module 130 is being advanced. Instead, a delay of a few seconds is incorporated into the control mechanism to run the conveyor 122 somewhat longer so the module 130 is pushed so it abuts, or nearly abuts, the module 132. The exact amount of the delay is determined by trial and error and then set into the control mechanism.

One or more electric eyes 138, 139 control motors 138, 140, 142 so a series of unwrapped modules may be presented to the gantry 120 and thereby deliver a continuous supply of cotton through the disperser 108 to the gin. Thus, the conveyors 104, 106 are sometimes run at faster speeds in order to close up modules presented to the conveyor 102.

This development allows considerable simplification of the devices shown in application Ser. Nos. 11/350,314 and 11/904,208 because the gantry 120 is not propelled along the path of the conveyor 102 and then retracted, meaning that the wheels and propulsion devices are eliminated. In addition, all of the electrical wiring and hydraulic hoses may be stationary rather than having to accommodate back and forth movement of the gantry 120. The cost of this simplification is the additional conveyor 122, the motor 124 and the necessary controls for the motor 124. Overall, there is considerable simplification and cost reduction. In addition, most of the gins which are retrofit to accept round plastic wrapped modules have dispersers in which the short conveyor does not extend substantially beyond the end of the disperser hood. In the embodiment of FIG. 3, no modification of these conventional dispersers is required.

Although this invention works best with roller bed conveyors, chain bed conveyors can be easily modified by separating the conveyor at a break between adjacent conveyor sections and adding the new conveyor 122 between the moved conveyor sections. This invention is probably not practical with existing moving floor conveyors because they are of one piece. However, this invention could be installed between moving floor conveyor sections, meaning that the upstream conveyor section can be moved, the gantry placed near its end and a separate conveyor installed in the space between the conveyors.

It is, of course, desirable to use the module feeder 100 to digest conventional rectangular modules, similar to modules 34, 48. If the conveyor 102 is shorter than the rectangular modules 34, 48, it is desirable to operate the conveyors 102, 122 together so they act as one conveyor and to use the laser or electric eye 126 to detect the leading and trailing edges of the rectangular module and thereby control the motors 116, 124, 138. If the conveyor 102 is at least as long as the regular modules 34, 48, it is convenient to operate the conveyors 114, 122 together so they act as one conveyor and to use an additional laser or electric eye 134 to detect the leading and trailing edges of the module.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A module feeder for digesting cotton modules comprising a disperser for reducing a cotton module into cotton clumps including a series of disperser drums and a first conveyor moving a cotton module into the drums;

second and third conveyors for moving cotton modules in a direction of movement toward the first conveyor; and a mechanism for removing a plastic wrapper from successive ones of the modules including a mechanism having a base that is immobile relative to the direction of movement of the conveyors, the mechanism comprising components located adjacent the second conveyor to remove a plastic wrapper from the module and, while removing the plastic cover, creating a gap between adjacent modules;

the third conveyor being between the second conveyor and the first conveyor, the first conveyor including a motor for driving the first conveyor at a first speed and the third conveyor includes a motor for driving the third conveyor at a first speed equal to the speed of the first conveyor and at a second speed substantially greater than the first speed for closing up the gap between adjacent modules.

2. The module feeder of claim 1 wherein the mechanism comprises a gantry.

3. The module feeder of claim 1 wherein the cotton modules measure a predetermined length in the direction of movement, the third conveyor being at least as long as the predetermined length.

4. The module feeder of claim 1 wherein the third conveyor substantially abuts the first conveyor and further comprising a module detector adjacent a junction between the first and third conveyors for driving the third conveyor at the second speed when no module appears at the junction.

5. The module feeder of claim 4 wherein the module detector is an electric eye.

6. The module feeder of claim 4 wherein the module detector is a laser.

7. The module feeder of claim 1 wherein there is only one third conveyor.

8. A module feeder for digesting cotton modules comprising a disperser for reducing a plastic wrapped cotton module into cotton clumps including a series of disperser drums and a first conveyor moving a cotton module into the drums;

a second conveyor for moving cotton modules in a direction of movement toward the first conveyor; and a mechanism for removing a plastic wrapper from successive ones of the modules including a mechanism having a base that is immobile relative to the direction of movement of the conveyors, the mechanism comprising components located adjacent the second conveyor and extending across the second conveyor to remove a plastic wrapper from the module and thereby creating a gap between adjacent modules;

there being at least one third conveyor between the second conveyor and the first conveyor, the third conveyor including means for moving the third conveyor at a speed greater than the first conveyor in response to an absence of a module at a junction between the first and third conveyors.

9. A method of operating a module feeder for digesting cotton modules comprising a disperser for reducing a cotton module into cotton clumps including a series of disperser drums and a first conveyor moving a cotton module into the drums; a second conveyor for moving cotton modules in a direction of movement toward the first conveyor; and a mechanism for removing a plastic wrapper from successive ones of the modules including a mechanism having a base that is immobile relative to the direction of movement of the conveyors, the mechanism comprising components located adjacent the second conveyor and extending across the second conveyor to remove a plastic wrapper from the module and, in the process of removing the plastic wrapper, creating a gap between adjacent modules; there being at least one third conveyor between the second conveyor and the first conveyor, the method comprising placing a first unwrapped module on the first and third conveyors and advancing the first and third conveyors at a first speed so the first unwrapped module on the first and third conveyors is advanced into the disperser;

removing a plastic wrapping from a second module while the first unwrapped module is being advanced into the disperser and, in the process of removing the plastic wrapping, creating a gap between the first and second modules;

placing the second module onto the second conveyor and then advancing the second module from the second conveyor onto the third conveyor;

detecting when a trailing end of the first module has moved off the third conveyor; and increasing the speed of the third conveyor until the second module substantially abuts the first module.

10. The module feeder of claim 2 wherein the gantry includes a mechanism adapted to pick a cotton module off the second conveyor, remove a plastic wrapper from the module and replace the cotton module on the second conveyor.

11. The module feeder of claim 8 wherein the components include a gantry.

12. The module feeder of claim 11 wherein the gantry includes a mechanism adapted to pick a cotton module off the second conveyor, remove a plastic wrapper from the module and replace the cotton module on the second conveyor.

* * * * *